US008187532B2

(12) United States Patent
Ohsone et al.

(10) Patent No.: US 8,187,532 B2
(45) Date of Patent: May 29, 2012

(54) RING-SHAPED DISK FOR GAS TURBINE

(75) Inventors: Jun Ohsone, Saitama (JP); Akira Mitsuhashi, Kitamoto (JP); Takanori Matsui, Saitama (JP); Yuji Ishiwari, Yokohama (JP)

(73) Assignee: MMC Superalloy Corporation, Saitama (JP)

( * ) Notice: Subject to any disclaimer, the term of this patent is extended or adjusted under 35 U.S.C. 154(b) by 0 days.

(21) Appl. No.: 12/991,511

(22) PCT Filed: May 8, 2009

(86) PCT No.: PCT/JP2009/058694

§ 371 (c)(1),
(2), (4) Date: Feb. 17, 2011

(87) PCT Pub. No.: WO2009/136636

PCT Pub. Date: Nov. 12, 2009

(65) Prior Publication Data

US 2011/0158844 A1 Jun. 30, 2011

(30) Foreign Application Priority Data

May 8, 2008 (JP) ..... 2008/121901

(51) Int. Cl.
*C22C 19/05* (2006.01)

(52) U.S. Cl. ..... 420/448

(58) Field of Classification Search ..... 420/448; 148/428

See application file for complete search history.

(56) References Cited

FOREIGN PATENT DOCUMENTS

| | | |
|---|---|---|
| EP | 0 260 510 A2 | 3/1988 |
| JP | A-61-53404 | 3/1986 |
| JP | A-02-224841 | 9/1990 |
| JP | A-10-265878 | 10/1998 |
| JP | A-2001-179391 | 7/2001 |
| JP | A-2004-36469 | 2/2004 |
| WO | WO 94/13849 A1 | 6/1994 |

OTHER PUBLICATIONS

Uginet et al., Alloy 718 Forging Development for Large Land-based Gas Turbines, Superalloys 718, 625, 706 and Derivatives 2005, edited by E.A. Loria, TMS (The Minerals, Metals & Materials Society), 2005, pp. 57-67.

Li et al., The Effect of δ-Phase on Crack Propagation under Creep and Fatigue Conditions in Alloy 718, Superalloys 718, 625, 706 and Various Derivatives, edited by E.A. Loria, TMS (The Minerals, Metals & Materials Society), 1994, pp. 545-555.

International Search Report mailed Aug. 11, 2009 for the corresponding International Application No. PCT/JP2009/058694.

Bewlay et al., "Net-shape manufacturing of aircraft engine disks by roll forming and hot die forging", Journal of Materials Processing Technology, Jan. 1, 2003, pp. 324-329.

European Search Report mailed Sep. 9, 2011 for the corresponding European patent application No. 09742760.3.

*Primary Examiner* — Jessee R. Roe

(74) *Attorney, Agent, or Firm* — Leason Ellis LLP.

(57) ABSTRACT

This ring-shaped disk for a gas turbine includes a ring-shaped disk material consisting of a Ni-based alloy, wherein the Ni-based alloy has a composition that includes, in terms of percent by mass, Ni: 50.00 to 55.00%, Cr: 17.0 to 21.0%, Nb: 4.75 to 5.60%, Mo: 2.8 to 3.3%, Ti: 0.65 to 1.15%, Al: 0.20 to 0.80%, and C: 0.01 to 0.08%, with the balance being Fe and inevitable impurities, and has a microstructure in which δ phase particles are distributed in a matrix thereof, and wherein, in the microstructure, flattened δ phase particles of which maximum length directions are oriented at angles within a range of 60 to 120° with respect to a radial direction of the ring-shaped disk material are present in an amount of 60% or more of a total amount of the δ phase particles distributed in the matrix.

1 Claim, 3 Drawing Sheets

RING-SHAPED DISK FOR GAS TURBINE

TECHNICAL FIELD

The present invention relates to a ring-shaped disk for supporting blades in a gas turbine and, more particularly, relates to a ring-shaped disk for a gas turbine that has excellent strength, in particular, excellent low cycle fatigue property for supporting blades in a gas turbine for an aircraft engine such as a jet engine or the like.

The present invention claims priority on Japanese Patent Application No. 2008-121901, filed on May 8, 2008, the content of which is incorporated herein by reference.

BACKGROUND ART

In general, as shown in a partially perspective view of FIG. 4, blades 2 are inserted to be mounted on the outer circumference of a ring-shaped disk 1 in a gas turbine. Both the ring-shaped disk 1 and the blades 2 are configured to rotate at a high speed. The ring-shaped disk 1 is made of a Ni-based alloy (for example, Inconel 718 or the like) having excellent heat resistance. The Ni-based alloy has a composition that includes, in terms of percent by mass (hereinafter, % indicates mass percent), 50.00 to 55.00% of Ni, 17.0 to 21.0% of Cr, 4.75 to 5.60% of Nb, 2.8 to 3.3% of Mo, 0.65 to 1.15% of Ti, 0.20 to 0.80% of Al, and 0.01 to 0.08% of C, with the balance being Fe and inevitable impurities, and has a microstructure in which δ phase particles are dispersed in a matrix thereof. The ring-shaped disk is manufactured as follows. First, a preformed ring material 3 shown in a perspective view of FIG. 2 is produced from a Ni-based alloy having the above-mentioned composition. The preformed ring material 3 is interposed between an upper die 4 and a lower die 5 as shown in FIG. 3, and a downward pressure in the direction of arrow A and an upward pressure in the direction of arrow B are exerted on the upper die 4 and the lower die 5, respectively. In this way, the preformed ring material 3 is subjected to die forging; and thereby, a ring-shaped forged material 9 is produced. Then the ring-shaped forged material 9 is machined so as to have a predetermined shape of the ring-shaped disk. As a result, the ring-shaped disk is produced (Non-Patent Documents 1 and 2).

Recently, with the size of aircrafts increasing, gas turbines of aircraft engines are getting larger while getting higher power. Therefore, components used in gas turbines for aircraft engines are required to have much higher strength. In particular, in response to the increasing size of the gas turbines, greater centrifugal force is applied to the ring-shaped disk. In addition, a difference in temperature between the center portion and the outer circumferential portion of the ring-shaped disk becomes larger; and thereby, a thermal stress applied in the circumferential direction becomes greater. Furthermore, if the ring-shaped disk is damaged due to its insufficient strength, here is a concern that the damage may lead to an aircraft trouble. Therefore, the ring-shaped disk is required to have much higher strength.

In addition, in the related art, the ring-shaped disk is manufactured by die forging as described above; and therefore, with the size of the ring-shaped disk increasing, much larger die forging machines are required. However, a large-sized die forging machine not only incurs a high cost in itself but also requires strengthening of the foundations on which the die forging machine is intended to be constructed. Therefore, it is inevitable that costs increase as the size of the die forging machine increases.

PRIOR ART DOCUMENTS

Non-Patent Documents

Non-Patent Document 1: Superalloy 718, 625, 706, and Derivatives 2005, E. A. Loria, TMS (The Minerals, Metals & Materials Society), 2005 pp 57 to 67.

Non-Patent Document 2: Superalloy 718, 625, 706, and Various Derivatives, E. A. Loria, TMS (The Minerals, Metals & Materials Society), 1994 pp 545 to 555.

DISCLOSURE OF THE INVENTION

Problems to be Solved by the Invention

The present invention has been made in light of the foregoing problems, and the present invention aims to provide a ring-shaped disk for a gas turbine that has excellent strength, in particular, excellent low cycle fatigue property for supporting blades in a gas turbine for an aircraft engine, such as a jet engine or the like.

Means for Solving the Problems

The inventors have conducted research in order to manufacture a large-sized ring-shaped disk having much higher strength at a low cost. As a result, the inventors have obtained the following research results.

(1) A ring-shaped disk having a microstructure in which a ratio of an amount of flattened δ phase particles extending in the tangential direction and distributed in a matrix of a Ni-based alloy to a total amount of δ phase particles is high, exhibits more improved strength, compared with that of a ring-shaped disk produced by die forging of the related art. In the case where, in the microstructure of the ring-shaped disk, the flattened δ phase particles of which the maximum lengths are oriented at angles within a range of 60 to 120° with respect to the radial direction of the ring-shaped disk, are present in an amount of 60% or more of the total amount of δ phase particles distributed in the matrix, the strength, in particular, the low cycle fatigue property, of the ring-shaped disk is improved significantly, compared with that of the ring-shaped disk produced by die forging of the related art.

(2) The ring-shaped disk having such a microstructure is produced by rolling a preformed ring material 3 using a ring rolling mill which includes a main roll 6, a mandrel roll 7, and axial rolls 8 and 8' as shown in FIG. 1.

The present invention is made based on the above-described study results, and has the following features.

The ring-shaped disk for a gas turbine of the present invention includes a ring-shaped disk material consisting of a Ni-based alloy. The Ni-based alloy has a composition that includes, in terms of percent by mass (hereinafter, % indicates mass percent), Ni: 50.00 to 55.00%, Cr: 17.0 to 21.0%, Nb: 4.75 to 5.60%, Mo: 2.8 to 3.3%, Ti: 0.65 to 1.15%, Al: 0.20 to 0.80%, and C: 0.01 to 0.08%, with the balance being Fe and inevitable impurities, and has a microstructure in which δ phase particles are distributed in a matrix thereof. In the microstructure, flattened δ phase particles of which maximum length directions are oriented at angles within a range of 60 to 120° with respect to the radial direction of the ring-shaped disk material are present in an amount of 60% or more of the total amount of the 6 phase particles distributed in the matrix.

Effects of the Invention

The ring-shaped disk for a gas turbine of the present invention has higher strength than that of a conventional ring-shaped disk for a gas turbine. Therefore, it is possible to use the ring-shaped disk with higher reliability, since the ring-shaped disk is not damaged even if the size of the ring-shaped disk is increased in response to the increased size of the gas turbine.

BEST MODE FOR CARRYING OUT THE INVENTION

A Ni-based alloy which constitutes a ring-shaped disk material of a ring-shaped disk for a gas turbine of the present invention has a composition that includes 50.00 to 55.00% of Ni, 17.0 to 21.0% of Cr, 4.75 to 5.60% of Nb, 2.8 to 3.3% of Mo, 0.65 to 1.15% of Ti, 0.20 to 0.80% of Al, and 0.01 to 0.08% of C with the balance being Fe and inevitable impurities, and has a microstructure in which δ phase particles are distributed in a matrix thereof. Since the Ni-based alloy is already known as, for example, Inconel 718, the reason why the composition is limited will not be described.

Here, the δ phase is an intermetallic compound of Ni and Nb, and its stoichiometric composition is $Ni_3Nb$. The crystal structure of the δ phase is orthorhombic, and is generally written as $D0_a$.

Figure 1:
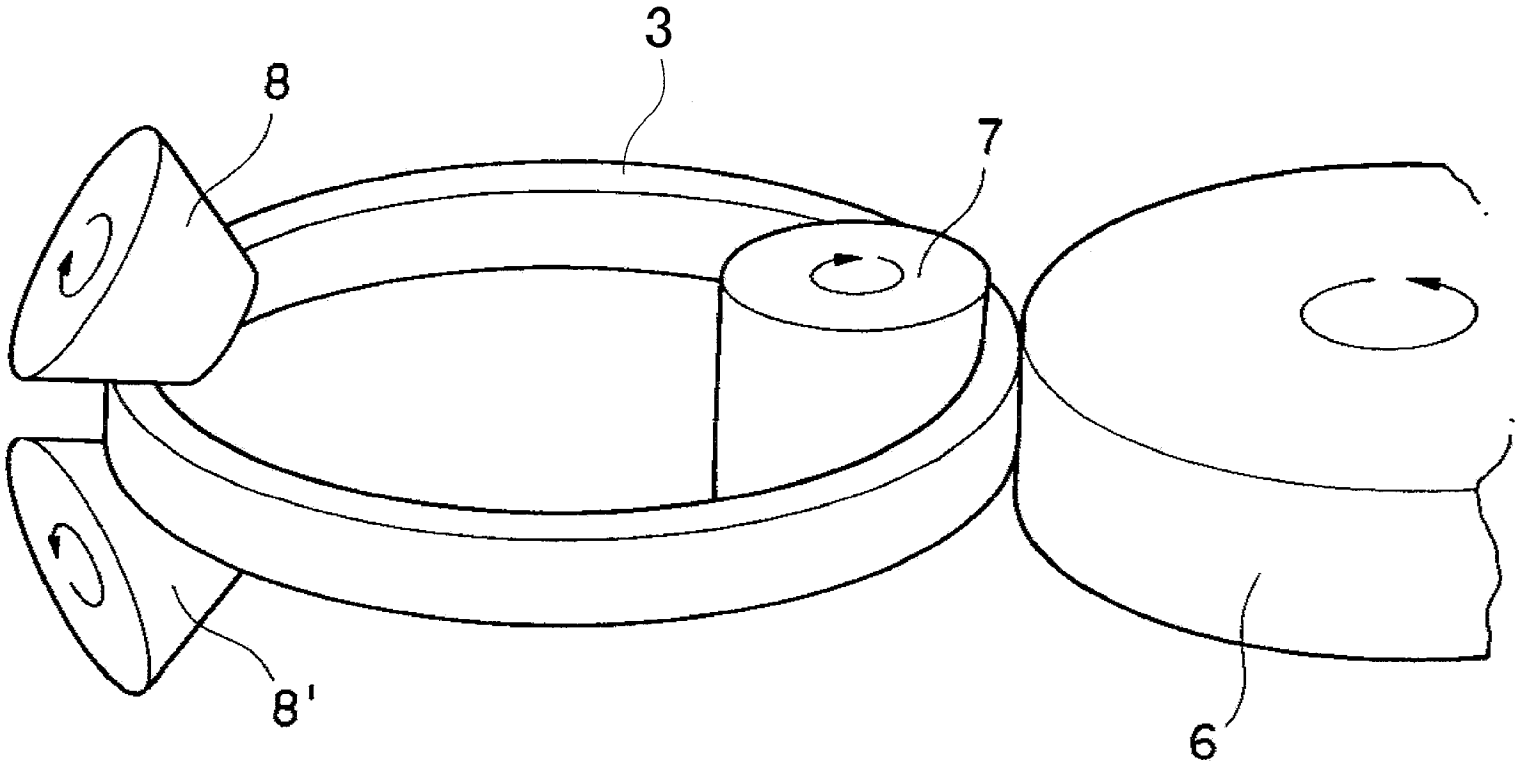
FIG. 1 is a perspective explanatory view showing a state in which a preformed ring material is subjected to rolling by a ring rolling mill.
Figure 2:
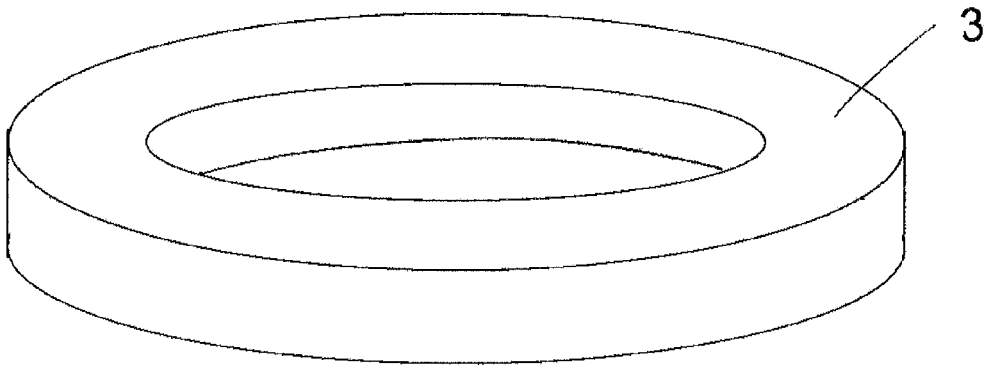
FIG. 2 is a perspective explanatory view of the preformed ring material.
Figure 3:
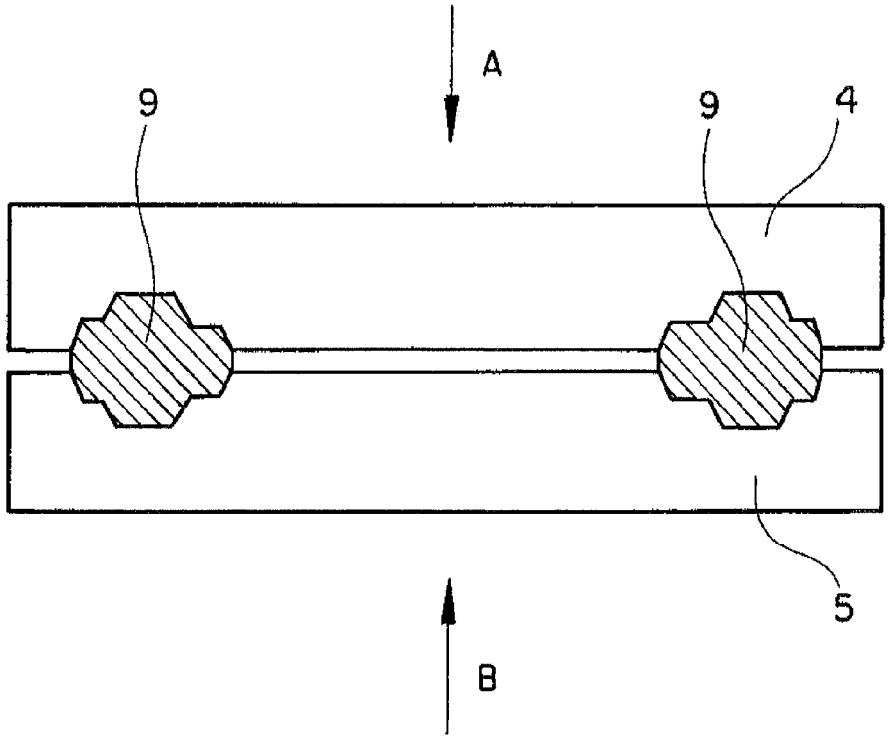
FIG. 3 is a cross-sectional view showing die forging of the related art.
Figure 4:
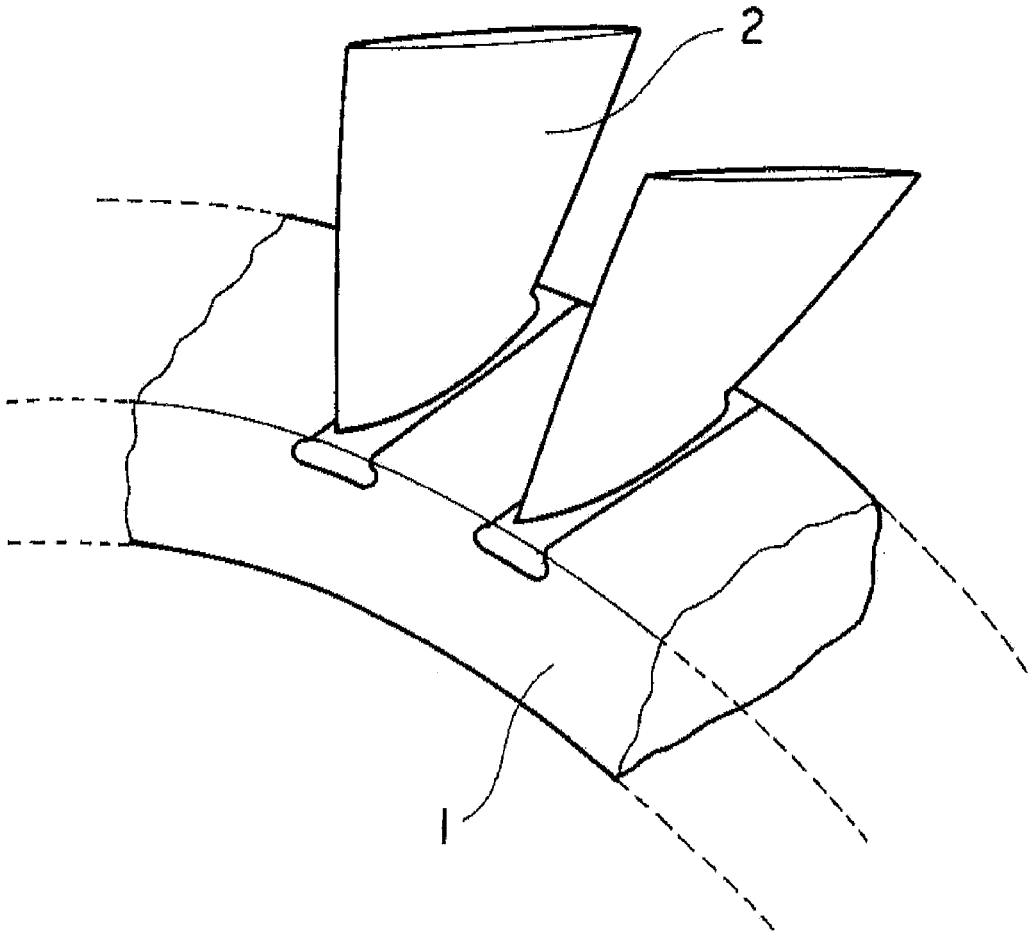
FIG. 4 is a partially perspective view showing a state in which blades are inserted to be mounted on the outer circumference of a ring-shaped disk in a gas turbine.

A preformed ring material 3, which is made of a Ni-based alloy having the above-mentioned composition and shown in FIG. 2, is subjected to ring rolling as shown in FIG. 1. A resultant ring-shaped disk material has a microstructure in which a ratio of an amount of flattened δ phase particles grown in the tangential direction and distributed in the matrix of the Ni-based alloy to a total amount of δ phase particles is high. In the matrix of the ring-shaped disk material having the microstructure in which the ratio of the amount of δ phase particles extending in the tangential direction to the total amount of δ phase particles is high, if the flattened δ phase particles of which the maximum length directions are oriented at angles within a range of 60 to 120° with respect to the radial direction of the ring-shaped disk material, are present in an amount of 60% or more of the total amount of the δ phase particles distributed in the matrix, the strength, in particular, the low cycle fatigue property of the ring-shaped disk material is greatly improved, compared with that of a conventional ring-shaped disk which is produced by die forging.

In the microstructure of the ring-shaped disk material of the ring-shaped disk for a gas turbine of the present invention, the reason why "the flattened δ phase particles of which the maximum length directions are oriented at angles within a range of 60 to 120° with respect to the radial direction of the ring-shaped disk material is present in an amount of 60% or more of the total amount of the δ phase particles distributed in the matrix" is described hereinafter.

If the flattened δ phase particles are distributed of which the maximum length directions are oriented at angles within a range of smaller than 60° or greater than 120° with respect to the radial direction of the ring-shaped disk material, sufficient property cannot be achieved. In addition, if the amount of the δ phase particles of which the maximum length directions are oriented at angles within a range of 60 to 120° with respect to the radial direction of the ring-shaped disk material is in a range of less than 60% of the total amount of the δ phase particles, sufficient property cannot be achieved.

A method of manufacturing the ring-shaped disk material of the ring-shaped disk for a gas turbine of the present invention is described hereinafter.

A Ni-based alloy having a composition that includes 50.00 to 55.00% of Ni, 17.0 to 21.0% of Cr, 4.75 to 5.60% of Nb, 2.8 to 3.3% of Mo, 0.65 to 1.15% of Ti, and 0.20 to 0.80% of Al with the balance being Fe and inevitable impurities is melted in a vacuum induction melting furnace so as to manufacture a first ingot. Here, the Ni-based alloy is already known as Inconel 718 or the like. The primary ingot is subjected to electroslag remelting so as to manufacture a second ingot, and the second ingot is subjected to vacuum arc remelting so as to manufacture a third ingot.

Then, the third ingot is subjected to hot forging so as to manufacture a billet which has an average grain size of ASTM No. 4 or finer. The billet is subjected to upset forging at a temperature within a range of 1000 to 1075° C. or upset forging and subsequent rolling by a ring rolling mill. Thereby, a preformed ring material is manufactured.

The preformed ring material is rolled by a ring rolling mill at a temperature within a range of 950 to 1015° C. such that the area reduction ratio of a cross section which includes a direction of an axis of rotational symmetry and a radial direction becomes 20% or more. Thereafter, the rolled ring material is subjected to aging heat treatment or solution and aging heat treatment. The ring-shaped disk material can be manufactured by the above-described method. Here, in the rolling by the ring rolling mill, heating prior to rolling and rolling may be conducted in combination several times.

EXAMPLES

Hereinafter, the ring-shaped disk for a gas turbine of the present invention is described in detail.

Examples and Comparative Examples

Ni-based alloys were melted by triple melting which consisted of vacuum induction melting, electroslag remelting, and vacuum arc remelting, and then were shapened by hot forging so as to manufacture billets having a diameter of 178 mm and a height of 377 mm. These billets had compositions as presented in Table 1 and average grain sizes which were finer than ASTM No. 6.

The billets were subjected to upset forging in a direction parallel to the longitudinal direction of the billets at a temperature of 1000° C., and then were subjected to punching and punch-out by forging. Thereby, preformed ring materials were manufactured which had an outer diameter of 340 mm, an inner diameter of 173 mm, and a thickness of 108 mm.

The performed ring materials were rolled by a ring rolling mill at rolling temperatures as presented in Table 2 such that they had an area reduction ratio (cross-section reduction ratio) as presented in Table 2.

Thereafter, the rolled ring materials were subjected to water cooling, and then were placed into a furnace of which the temperature was maintained at 718° C. The rolled ring materials were left in the furnace at the above-described temperature for 8 hours. Afterwards, the temperature of the furnace was continuously lowered for 2 hours to 621° C., and then was maintained for 15 hours. Ring-shaped disk materials manufactured in this manner were taken out of the furnace.

In this manner, ring-shaped disks of inventive examples 1 to 9 and ring-shaped disks of comparative examples 1 to 3, which were composed of the ring-shaped disk materials, were manufactured.

Conventional Example 1

A preformed ring-shaped material, which had an outer diameter of 400 mm, an inner diameter of 285 mm, and a thickness of 115 mm, and had a composition as presented in Table 1, was manufactured in the same manner as in inventive examples and comparative examples.

The preformed ring-shaped material was subjected to die forging under conditions where a temperature and a height reduction ratio were set to values as presented in Table 2.

Thereafter, the ring-shaped material which had been subjected to die forging was subjected to water cooling, and then was placed in a furnace of which the temperature was maintained at 718° C. The ring-shaped material was left in the furnace at the above-described temperature for 8 hours. Afterwards, the temperature of the furnace was lowered continuously for 2 hours to 621° C., and then was maintained for 15 hours. A ring-shaped disk material manufactured in this manner was taken out of the furnace.

In this manner, a ring-shaped disk of conventional example 1, which was composed of the ring-shaped disk material, was manufactured.

Here, in Table 2 below, the symbol # indicates a press forging temperature, the symbol ## indicates a reduction ratio (a height reduction ratio). The symbol * indicates a value that deviates from the range of the present invention.

TABLE 1

| RING DISK | | COMPOSITION | | | | | | | |
|---|---|---|---|---|---|---|---|---|---|
| | | Ni | Cr | Nb | Mo | Ti | Al | C | Fe and INEVITABLE IMPURITIES |
| INVENTIVE EXAMPLE | 1 | 53.90 | 17.9 | 5.36 | 2.9 | 0.99 | 0.51 | 0.02 | BALANCE |
| | 2 | | | | | | | | |
| | 3 | | | | | | | | |
| | 4 | | | | | | | | |
| | 5 | | | | | | | | |
| | 6 | | | | | | | | |
| | 7 | 54.10 | 18.1 | 5.38 | 2.9 | 1.00 | 0.51 | 0.02 | BALANCE |
| | 8 | | | | | | | | |
| | 9 | | | | | | | | |
| COMPARATIVE EXAMPLE | 1 | | | | | | | | |
| | 2 | | | | | | | | |
| | 3 | | | | | | | | |
| CONVENTIONAL EXAMPLE 1 | | 53.99 | 17.9 | 5.37 | 2.9 | 1.00 | 0.52 | 0.03 | BALANCE |

TABLE 2

| RING DISK | | ROLLING CONDITIONS OF ROLLING MILL | | RATIO (%) OF AMOUNT OF δ PHASE PARTICLES TO TOTAL AMOUNT OF δ PHASE PARTICLES, WHICH HAVE MAXIMUM LENGTH DIRECTIONS | NUMBER OF CYCLES (TIMES) |
|---|---|---|---|---|---|
| | | ROLLING TEMPERATURE (° C.) | CROSS-SECTION REDUCTION RATIO (%) | ORIENTED WITHIN 60 TO 120° WITH RESPECT TO RADIAL DIRECTION | UNTIL LOW CYCLE FATIGUE SPECIMEN IS FRACTURED |
| INVENTIVE EXAMPLE | 1 | 1000 | 38.9 | 75.6 | 64816 |
| | 2 | 1001 | 28.4 | 63.8 | 41865 |
| | 3 | 990 | 24.6 | 60.1 | 41305 |
| | 4 | 1003 | 26.3 | 66.3 | 34232 |
| | 5 | 981 | 32.5 | 70.2 | 55874 |
| | 6 | 998 | 40.1 | 81.9 | 67896 |
| | 7 | 1007 | 33.2 | 73.4 | 57226 |
| | 8 | 1004 | 45.9 | 80.1 | 64523 |
| | 9 | 969 | 40.3 | 72.1 | 42965 |
| COMPARATIVE EXAMPLE | 1 | 1015 | 24.6 | 54.8* | 25612 |
| | 2 | 1013 | 22.4 | 43.2* | 24326 |
| | 3 | 954 | 20.4 | 33.1* | 16327 |
| CONVENTIONAL EXAMPLE 1 | | 1000# | 39.1## | 27.7* | 15664 |

(Observation of Microstructure by Microscope)

With regard to the manufactured ring-shaped disks of inventive examples 1 to 9, comparative examples 1 to 3, and conventional example 1, micrographs of the microstructure of the cross-section perpendicular to the axis of each ring-shaped disk were photographed. With regard to δ phase particles observed in the micrographs of each microstructure, the number of δ phase particles of which the maximum length direction was oriented at an angle within a range of 60 to 120° with respect to the radial direction of the ring-shaped disk, was measured. And a ratio (%) of the measured number to the total number of δ phase particles was calculated. Obtained results are presented in Table 2.

(Conditions of Low Cycle Fatigue Test)

The manufactured ring-shaped disks of inventive examples 1 to 9, comparative examples 1 to 3, and conventional example 1 were subjected to a low cycle fatigue test under the following conditions.

A low cycle fatigue specimen was sampled from each ring-shaped disk by cutting it parallel to the tangential direction of the ring-shaped disk. With regard to the low cycle fatigue specimen, the length of a reduced section was 18.5 mm, the diameter of a reduced section was 6.35 mm, and the gage length was 13 mm. The low cycle fatigue specimen was heated at a temperature of 400° C., and a tensile load and a compression load were alternately and repeatedly applied to the heated low cycle fatigue specimen at a frequency of 30 cycles/min under conditions where the maximum strain was 0.8% and the A-ratio (alternating strain/mean strain) was 1.0. Thereby, the low cycle fatigue test was carried out. Next, the number of cycles (times) until each low cycle fatigue specimen was fractured was determined. The obtained results are presented in Table 2.

Referring to the results presented in Table 1 and 2, in the case of the ring-shaped disks of inventive examples 1 to 9, the numbers of cycles until the low cycle fatigue specimen were fractured are significantly greater than those in the case of the ring-shaped disks of comparative examples 1 to 3 and conventional example 1. Therefore, it can be understood that the ring-shaped disks of inventive examples 1 to 9 have much better low cycle fatigue properties than those of the ring-shaped disks of comparative examples 1 to 3 and conventional example 1.

INDUSTRIAL APPLICABILITY

The ring-shaped disk for a gas turbine of the present invention can be suitably applied to a gas turbine for a large-sized aircraft engine that requires much higher strength, because in particular, the ring-shaped disk for a gas turbine of the present invention has excellent low cycle fatigue property.

BRIEF DESCRIPTION OF SYMBOLS

1 ring-shaped disk (ring-shaped disk material)

The invention claimed is:

1. A ring-shaped disk for a gas turbine comprising a ring-shaped disk material consisting of a Ni-based alloy, wherein the Ni-based alloy has a composition that comprises, in terms of percent by mass, Ni: 50.00 to 55.00%, Cr: 17.0 to 21.0%, Nb: 4.75 to 5.60%, Mo: 2.8 to 3.3%, Ti: 0.65 to 1.15%, Al: 0.20 to 0.80%, and C: 0.01 to 0.08%, with the balance being Fe and inevitable impurities, and has a microstructure in which δ phase particles are distributed in a matrix thereof, and wherein, in the microstructure, flattened δ phase particles of which maximum length directions are oriented at angles within a range of 60 to 120° with respect to a radial direction of the ring-shaped disk material are present in an amount of 60% or more of a total amount of the δ phase particles distributed in the matrix.

* * * * *